United States Patent [19]

Itaya

[11] 4,227,392

[45] Oct. 14, 1980

[54] SPRING WINDING MACHINE

[75] Inventor: Reijiro Itaya, Tokyo, Japan

[73] Assignee: Itaya Seisakusho Co., Ltd., Tokyo, Japan

[21] Appl. No.: 946,517

[22] Filed: Sep. 28, 1978

[30] Foreign Application Priority Data

Oct. 5, 1977 [JP] Japan ..... 52-119605
Oct. 5, 1977 [JP] Japan ..... 52-119606

[51] Int. Cl.[2] ..... B21S 35/02
[52] U.S. Cl. ..... 72/137; 72/145; 72/166
[58] Field of Search ..... 72/137, 135, 140, 145, 72/166

[56] References Cited

U.S. PATENT DOCUMENTS

| | | | |
|---|---|---|---|
| 2,248,440 | 7/1941 | Schmid | 72/137 X |
| 2,794,477 | 6/1957 | Sjöbohn | 72/137 X |
| 3,402,584 | 9/1968 | Cavagnero | 72/137 |

FOREIGN PATENT DOCUMENTS 2264589 4/1974 Fed. Rep. of Germany .

*Primary Examiner*—Leon Gilden
*Attorney, Agent, or Firm*—Young & Thompson

[57] ABSTRACT

A coil winding machine provides a wire guide member having a wire feed channel therein and a support member turnably arranged in relation to the wire guide member and provided with a turnable core bar member of semi-circular shape in the vicinity of an open end of the wire feed channel with a roll stopper for suppressing movement of the tool and a tool member movable between the core bar member and the roll stopper.

6 Claims, 10 Drawing Figures

SPRING WINDING MACHINE

This invention relates to a spring winding machine or a coiling machine.

The conventional spring winding machine provides a wire guide member through which a wire is constrained to pass under the urging of a feed roller unit arranged behind the guide member and a tool member arranged in front of the guide member for bending, incurvating or cutting the wire.

In the operation of the coiling machine of the mentioned type, an end of the wire after being extruded from an open end of the guide member comes into collision with the tool for abrupt bending at an angle in the vicinity of the open end of the guide member as illustrated in FIGS. 1 and 2, thus a straight portion with a curve are inevitably formed in the starting end of the wire as shown in FIGS. 3 and4.

Further, in the conventional coiling machine, a core bar member even integrally formed with the wire guide member at the vicinity of the open end thereof, is not always oriented at a right angle to the direction of movement of the tool member, so that a coil spring of the type having a hook at the starting end of the coil could not be obtained.

To overcome the foregoing disadvantages and incoveniences in accordance with the invention, the core bar member is arranged to turn in cooperation with movements of a plurality of tools radially arranged, so that the core bar member in its longitudinal direction is always directed normal to each tool.

The tool member is slidably mounted through a sliding table on a holding member fixed to a base member positioned normal to the wire guide member.

As hereinbefore described, the wire is constrained to pass through the wire guide member under the urging of the feed roller unit and the starting terminal of the wire urges the tool from the first position shown by a solid line to a second position shown by a dotted line in FIG. 5. This ovbiously disturbs further coiling operation of the machine and the differences in degree of the displacement or deflection of the tool under the pressure applied by the wire being fed are liable to make inferior or irregular products.

A general object of the invention is therefore to provide a spring winding machine capable of winding a coil spring of regular form and excellent quality.

A principal object of the invention is to provide a spring winding machine which provides a core bar member which is turnable in cooperation with movements of the tools radially arranged around the wire guide member. Namely, a core bar member is supported by a support member which is in turn rotatably coupled through a bearing to a holder for holding a wire guide member. The support member at its base circumference coacts with a gear member for rotation.

Another object of the invention is to provide a spring winding machine which provides a tool stopper which is cooperative with movements of the tools. The tool stopper is also supported by the support member in juxtaposition with the core bar member as hereinafter fully described.

In order that the invention may be more readily understood and so that further features thereof may be appreciated the invention will now be described, by way of example, with reference to the accompanying drawings, in which.

Figure 1:
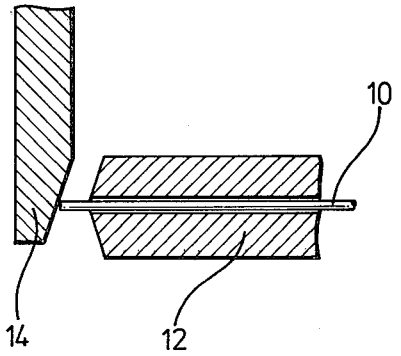
FIG.1 PRIOR ART
FIGS. 1 through 5 are fragmentarily enlarged sectional views depicting the conventional wire coiling steps.
Figure 2:
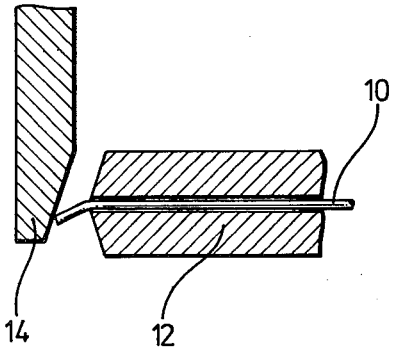
FIG.2 PRIOR ART
Figure 3:
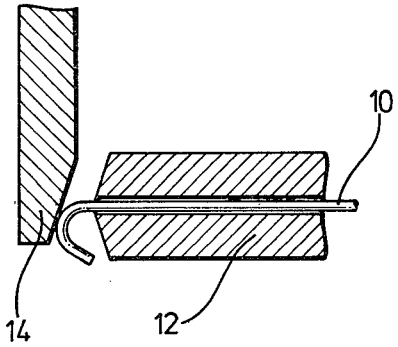
FIG.3 PRIOR ART
Figure 4:
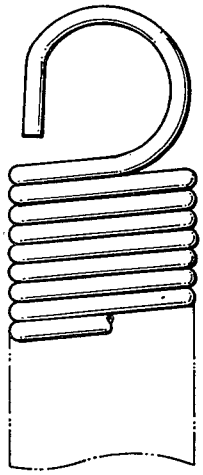
FIG.4 PRIOR ART
Figure 5:
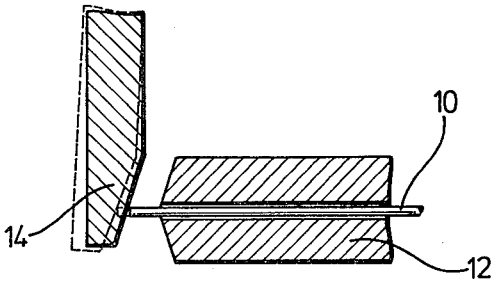
FIG.5 PRIOR ART

As hereinbefore described, FIGS. 1 to 5 depict the coiling operation of the conventional spring winding machine with disadvantageous results in which the wire 10 is supplied through the wire guide member 12 until the leading end of the wire 10 comes to collision with a tool 14 for bending it dowanwardly at an angle as shown in FIG. 2.

Figure 6:
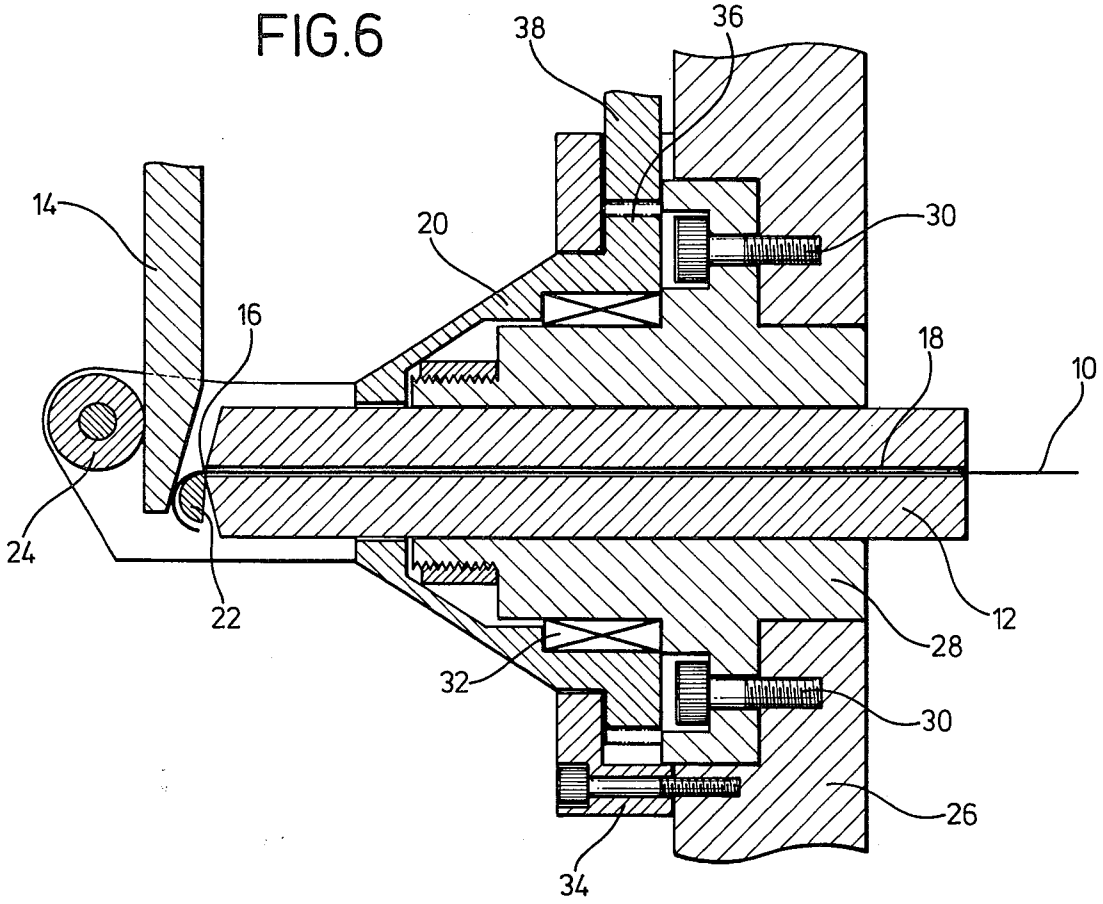
FIG. 6 is a sectional view of the spring winding mechanism according to the invention.

FIG. 6 shows a machine according to the invention in which the the wire 10 is continuously delivered through an open end 16 of a feed channel 18 provided in the wire guide member 12 by means of a feed roller as hereinafter described.

The tools 14 are disposed radially around an axis to be extended from the wire guide member 12 and movably against the open end 16 thereof.

The wire guide member 12 is supported by a support member 20 which is intermittently turnable around an axis of the wire guide member 12 so that the tool when moved never collides with the extended end of the support member 20. To the support member 20 is secured a core bar member 22 of a semi-circular cylinder form so that the semi-circular face of the member 22 is confronted with the tool 14 and also the edge of the member 22 is engaged with the open end 16 of the feed channel 18. By this arrangement the starting end of the wire on commencement of the coiling operation may be smoothly incurvated without leaving any straight portion as hereinbefore pointed out.

Further, the support member 20 is provided with a roll stopper 24 in juxtaposition with the core bar member 22 so that the tool 14 is positioned therebetween. Thus, even when a pressure is applied to the roll stopper 24 by the wire 10 delivered through the wire guide member 12, movement of the tool 14 is suppressed or minimized by the roll stopper 24, which enables making the coil spring of predetermined design without leaving any straight portion.

The wire guide member 12 is fixed to a base member 26 through a wire guide holder 28 by means of a screw fastener 30.

The support member 20 is turnably coupled to the wire guide holder 28 through a bearing 32 and to the base member 26 is fixed a ring 34 which serves to suppress upward movement of the support member 20 toward the base member 26. By this arrangement, even when the wire 10 delivered from the open end of the feed channel 18 urges the tool 14 to push the roll stopper 24 secured to the support member 20, the roll stopper 24 still remains stationary since movement of the support member 20 is suppressed by the ring 34.

The support member 20 at its base periphery is provided with a driven gear 36 meshing with a drive gear 38 which is turned intermittently cooperatively with movement of the tool 14, so that the tool 14 never collides with the support member 20.

In FIGS. 7 to 10, the four tool units 14 are arranged on the crossed axes; i.e. the horizontal axis and the vertical axis and between a small gear 40 which is integrally rotatable with a cam member 42 and the drive gear 38 a convenient intermittent rotary motion transmission mechanism such as a geneva stop is disposed to slide the tool 14. In case the tool units 14 are arranged in positions other than with crossed axes the corresponding escape gears are conveniently arranged with cams provided in proportion to the numbers and locations of the tool units. These cams are rotated by the small gear 40 which actuates the tool 14 to rotate the drive gear 38 for intermittent turning of the support member 20 in cooperation with movement of each tool 14, so that the tool 14 which has finished one cycle of work is moved while a fresh tool comes without any collision with the support member 20.

As hereinbefore described, an intermittent rotation of the support member 20 cooperative with movements of each tool may be carried out by not only the convenient cam or the escape gear but also by a pulse motor for driving the drive gear 38 with a pulse signal predetermined so as to cooperate with movements of each tool.

Figure 8:
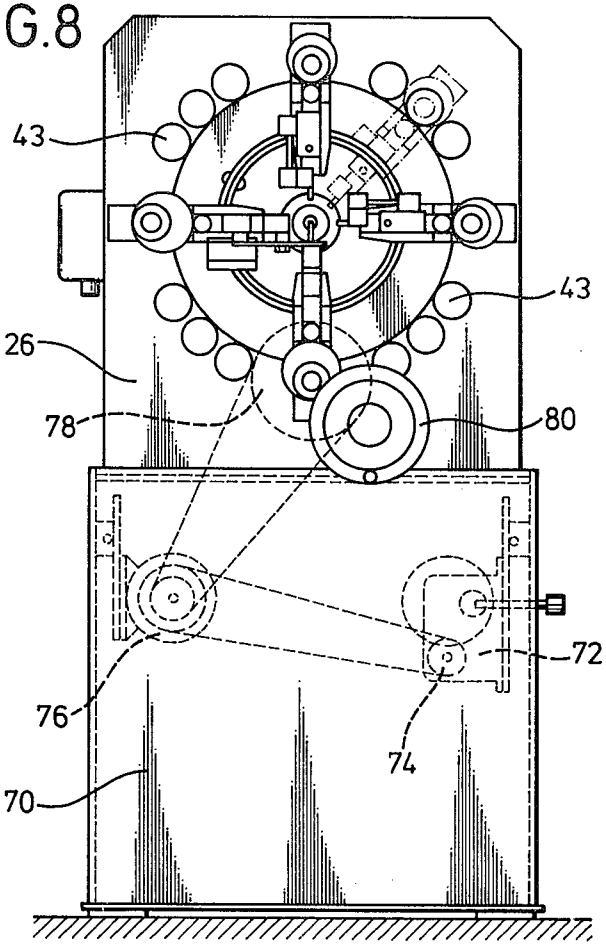
FIG. 8 is a front elevation of the spring winding machine of another embodiment of the invention.

In the base member 26, a number of apertures 43 are provided around the open end of the wire guide channel 18 as best shown in FIG. 8 and into the apertures 43 convenient bearings are inserted for fixation therein to rotatably support a shaft 44 to one end of which the small gear 40 is secured and to the opposite end of which the cam 42 is secured. The small gear member 40 coacts with a large gear 48 which turns around an axis of the wire guide member 12 to turn the cam member 42 which actuates the tool member 14 for movement thereof in cooperation with rotation of the support member 20 as hereinbefore described.

On the base 26 is mounted a holding member 50 which is provided with a dovetail groove 52 to receive a sliding member 58 which is provided with a compressible roller 60 adapted to absorb variation in diameter of the cam 42 due to rotation for smooth sliding of the sliding member 58. The sliding member 58 may be urged against the cam member 42 by means of a suitable spring (not shown) and also the cam member 42 may be provided with an annular groove.

Figure 10:
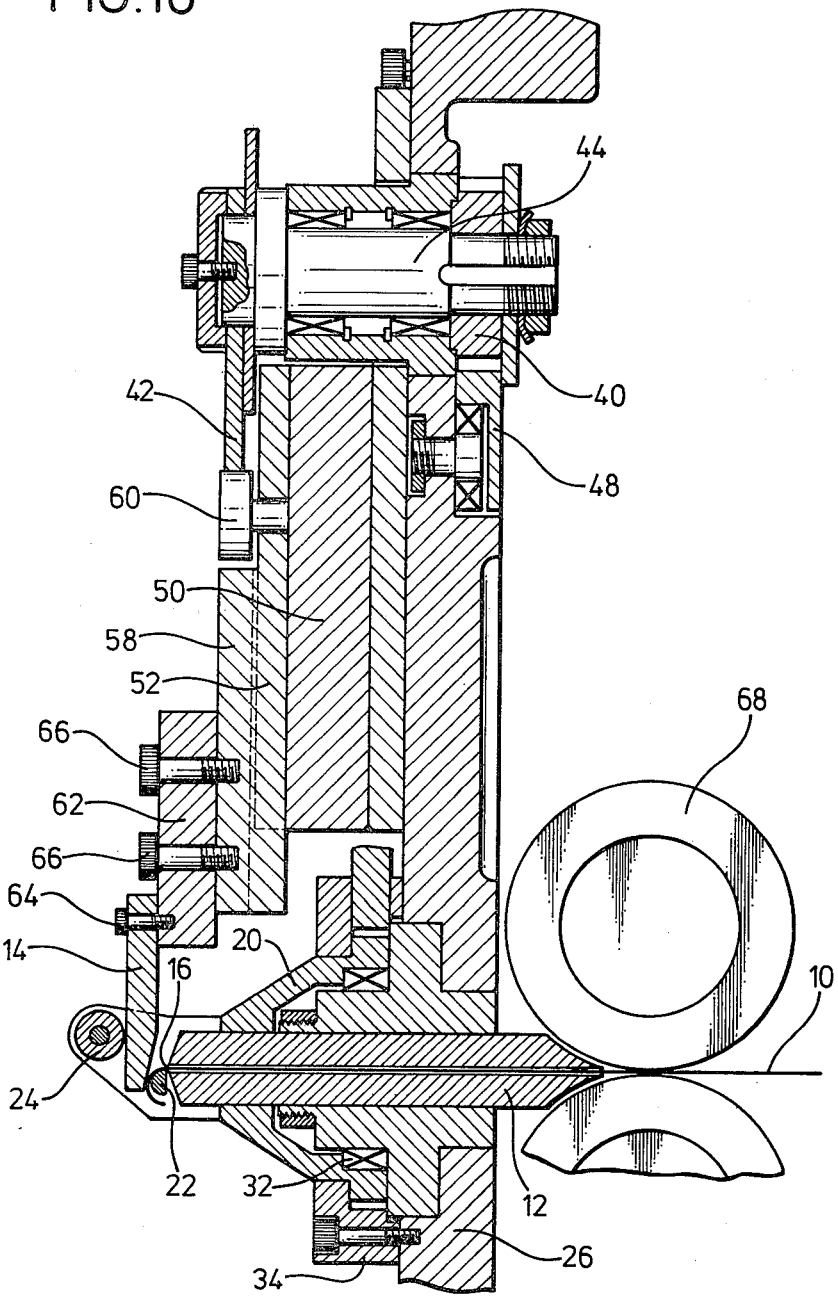
FIG. 10 is a longitudinally sectioned elevation of the spring winding machine with the spring winding mechanism according to the invention.

In FIG. 10, the tool 14 is secured to a frame member 62 by means of a screw fastener 64 and the frame member 62 is in turn secured to the sliding member 58 by means of screw fasteners 66, 66.

A wire feed roller 68 is disposed behind the wire guide member 12 for forcedly feeding the wire 18 into the wire guide member 12 and the roller 68 is driven by a motor 69 which is subjected to starting, stopping and reduction of speed with pulse signals.

Figure 7:
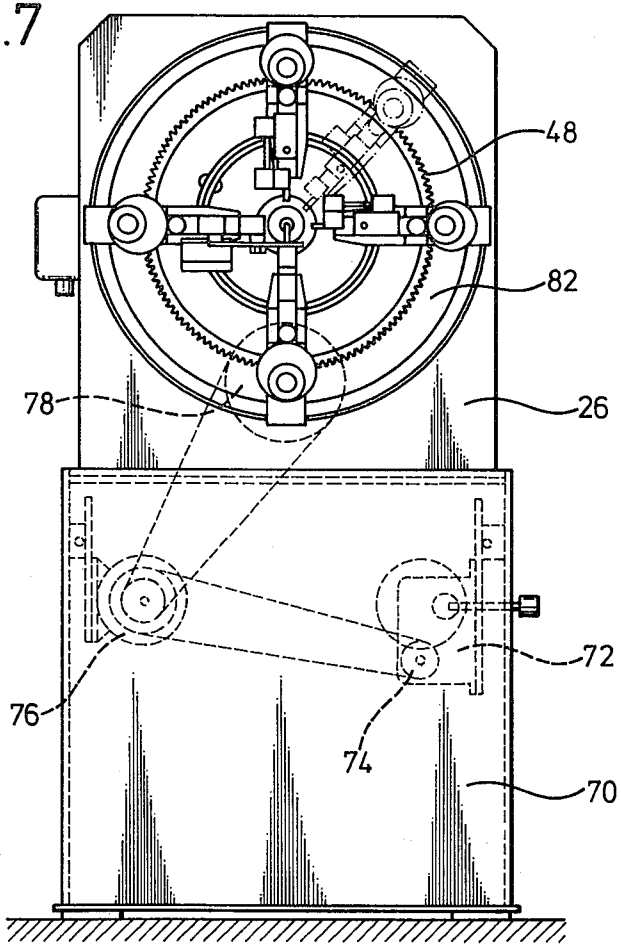
FIG. 7 is a front elevation of the spring winding machine of the invention.
Figure 9:
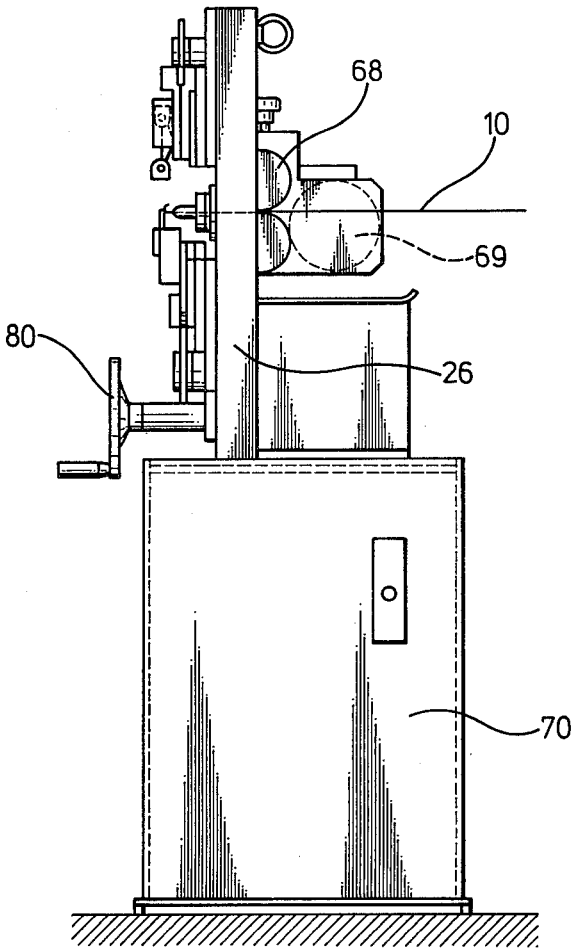
FIG. 9 is a lateral view of the machine of FIG. 8.

In FIG. 7, the base member 26 is fixedly mounted on a bed member 70 in which a motor 72 is arranged to rotate one of the small gears 40 through a pulley 74, a reduction gear 76 and a sprocket 78 thereby to turn the large gear 48 with revolutions of the other small gears 40 arranged around the large gear 48 for movements of the tools a predetermined order, at predetermined speeds and times and to the predetermined locations under the control of the cams 42 of specified shape without entailing any collision of the tools with each other. The large gear 48 may also be operated manually with a hand wheel 80.

The reference numeral 82 designates an annular groove which corresponds to the apertures 43 as shown in FIG. 8 and a periphery of the large gear 48 is entirely exposed in the annular groove 82 so that the small gears 40 may be located at any position around the periphery of the large gear 48. In this embodiment, the holding member 20 carrying a shaft to which the cam 42 and the small gear 40 are fitted is mounted on the base member 26 through a dovetail groove provided therein.

In accordance with the present invention, at first the starting end of the wire 10 when delivered from the open end of the channel 18 comes into contact with the tool 14 and immediately thereafter is incurvated around the core bar member 22 as best shown in FIGS. 6 and 10 without forming any straight or angularly bent portion.

Particularly, in accordance with the present invention, the tool units 14 are radially arranged around the wire guide member 12 for radial movements in order and the core bar member 22 is turned in cooperation with movements of the tool units 14 so that the core bar member 14 in its longitudinal direction is normal to the direction of movement of the tool 14. Thus, a coil spring having hooks at its opposite ends may be produced without forming any straight or angularly bent portion. If, however, it is desired to form a straight or angularly bent portion at the ends of the coil spring, the support member 20 may be turned by means of the escape gear, the cam and pulse motor so that the axial direction of the core bar member is not normal to the direction of movement of the tool.

Further, as hereinbefore fully described, in accordance with the present invention the stopper 24 is provided in the support member so as to suppress movement of the tool 14 when pushed by the wire 10 delivered from the wire guide member 12, which enables to produce a coil spring of predetermined design with less production of inferior and irregular articles.

While the invention has been shown and described with reference to a preferred embodiment, it will be understood by those skilled in the art that various changes in form and detail may be made therein without departing from the spirit and scope of the invention defined in the appended claims.

I claim:

1. A coil winding machine comprising a wire guide member having a wire feed channel therein, and a support member turnably arranged in relation to the wire guide member and provided with a turnable core bar member of semi-circular shape and at least one tool member movable toward and away from the core bar member, characterized in that the edge of the turnable core bar member is engaged with an open end of the wire feed channel with a round surface confronting the tool member, and the tool member is turnable with the support member, so that the core bar member in its longitudinal direction is always directed normal to the direction of movement of the tool.

2. A coil winding machine as claimed in claim 1, and a roll stopper against which said tool member movably bears on the side of said tool member opposite said core bar member thereby to limit movement of said tool member away from said core bar member.

3. A coil winding machine as claimed in claim 1, in which a plurality of said tools are radially and movably arranged around the axis of said wire guide member.

4. A coil winding machine comprising a wire guide member having a wire feed channel therein, a support member mounted for rotation about the axis of the wire feed channel and carrying a core bar member of arcuate shape and at least one tool member movable toward and away from the core bar member in a direction radially of said axis, said core bar member being perpendicular to said axis and to direction of movement of said tool member, said tool member and core bar member being so disposed relative to said wire feed channel that said tool member, when in a position adjacent said core bar member, deflects wire emerging from said wire feed channel into an arcuate configuration about said core bar member, rotation of said support member permitting said wire to be wound in various directions at angles to each other.

5. A coil winding machine as claimed in claim 4, and a roll stopper against which said tool member movably bears on the side of said tool member opposite said core bar member thereby to limit movement of said tool member away from said core bar member.

6. A coil winding machine as claimed in claim 4, in which a plurality of said tools are radially and movably arranged around the axis of said wire guide member.

* * * * *